United States Patent [19]

Yoshitomi et al.

[11] 4,142,581

[45] Mar. 6, 1979

[54] TUBE-HOLE STRUCTURE FOR EXPANDED TUBE-TO-TUBE-SHEET JOINT

[75] Inventors: Yuji Yoshitomi; Zensuke Tamura; Hideaki Kamohara; Keiji Omura; Yoshimasa Murakami; Tadasi Takata; Teruo Nuwa, all of Kudamatsu, Japan

[73] Assignee: Hitachi, Ltd., Japan

[21] Appl. No.: 782,743

[22] Filed: Mar. 30, 1977

[30] Foreign Application Priority Data

Apr. 2, 1976 [JP] Japan ..... 51-35929

[51] Int. Cl.[2] ..... F28F 9/16; F16L 41/00

[52] U.S. Cl. ..... 165/173; 29/157.4; 29/523; 285/222; 285/382.4

[58] Field of Search ..... 29/157.4, 523; 165/173, 165/175, 178; 285/222, 382.4

[56] References Cited

U.S. PATENT DOCUMENTS

| | | | |
|---|---|---|---|
| 2,080,374 | 5/1937 | McAllister | 29/157.5 |
| 3,428,338 | 2/1969 | Corwin | 29/157.4 |
| 3,710,434 | 1/1973 | Daniels et al. | 29/523 |
| 3,717,925 | 2/1973 | Hardwick | 29/157.4 |
| 3,982,778 | 9/1976 | Spencer et al. | 29/523 |

*Primary Examiner*—Charles J. Myhre
*Assistant Examiner*—Sheldon Richter
*Attorney, Agent, or Firm*—Craig & Antonelli

[57] ABSTRACT

A tube-hole structure for an expanded tube-to-tube-sheet joint which is formed by axially moving a rod within each tube member in each tube hole of the tube sheet by external drive means, thereby imparting an elastic mass placed inside the tube with a sufficient compressive load to expand the tube uniformly in the radial direction to provide a rigid joint between the tube and tube hole, characterized in that each tube hole has at least one circumferential groove with an axial dimension or length of $1.5/\beta$ to $3.0/\beta$ ($\beta$ being $$\sqrt[4]{\frac{3(1-\nu^2)}{R^2t^2}},$$

where R is the mean radius of the tube member to be expanded, t is the wall thickness of the tube, and $\nu$ is the Poisson's ratio).

8 Claims, 13 Drawing Figures

F I G. I

TUBE-HOLE STRUCTURE FOR EXPANDED TUBE-TO-TUBE-SHEET JOINT

This invention relates to a tube-hole structure for an expanded tube-to-tube-sheet joint, and more specifically to a tube-hole structure in which an expansible tube member is radially expanded and secured in place by a tube expander inserted therein, for example, in the tube sheet of a heat exchanger wherein the heat-transfer tubes are expanded and joined together.

Usually with the shell-and-tube heat exchangers, boilers, and other multitubular equipment, it is common that the tubes are inserted in the tube-sheet holes and radially expanded and secured in place. To be more concrete, a cylindrical tube-expanding medium of elastic material is introduced into the tube to be expanded, and the medium is axially compressed allowing the mass to expand radially. The surface pressure of the medium thus being deformed is utilized in expanding the tube radially against the surrounding wall of the tube hole so as to secure the tube to the tube sheet.

The method just mentioned above, known as a uniformly-stretching tube-expanding method, is in widest use. Also known are a mechanical method using a rotating mandrel for tube expansion, an explosion method which utilizes an explosive for the purpose, and a direct-pressing method making use of oil hydraulics.

All of the ordinary tube-expanding methods, including those cited above, make it possible to form expanded tube-to-tube-sheet joints. Whatever method may be employed, the problem of prime importance will be the bond strength and watertightness of the resulting joint between the tube sheet and each heat-transfer tube. In heat exchangers the tube ends after the expansion are commonly welded to the tube sheet. If the bond strength is insufficient, each expanded tube end will be unable to bear the load being axially applied on the tube. Consequently, the welded tube-end portion will be subjected to most of the axial load, and the weld will crack. If the watertightness is inadequate, a corrosive fluid on the shell side can permeate into the weld during the operation of the heat exchanger, leading to stress corrosion and cracking. Thus, if both the bond strength and watertightness of the tube-and-tube-sheet joint are insufficient, the reliability will be lost in that part of the heat exchanger. Improvements in these respects have most urgently been called for in the art of tube expansion.

The present invention has been perfected with the foregoing in view, and has for its object the provision of a tube-hole for an expanded tube-to-tube-sheet joint which is formed by expanding the tube securely in the tube hole by means of a tube expander and still attains greater bond strength and watertightness at the joint than in conventional joints of the character.

This objective of the invention is attained by providing a tube-hole structure having at least one circumferential groove on the surrounding wall of each hole of a tube sheet in which each tube member is radially expanded to give a tube-to-tube-sheet joint.

The above and other objects, features, and advantages of the invention will become apparent from the following detailed description taken in connection with the accompanying drawings showing preferred embodiments thereof. In the drawings.

Figure 5A:
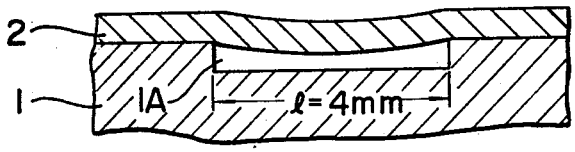
Figure 5B:
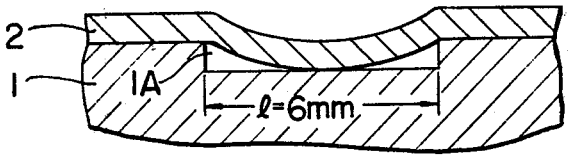
Figure 6:
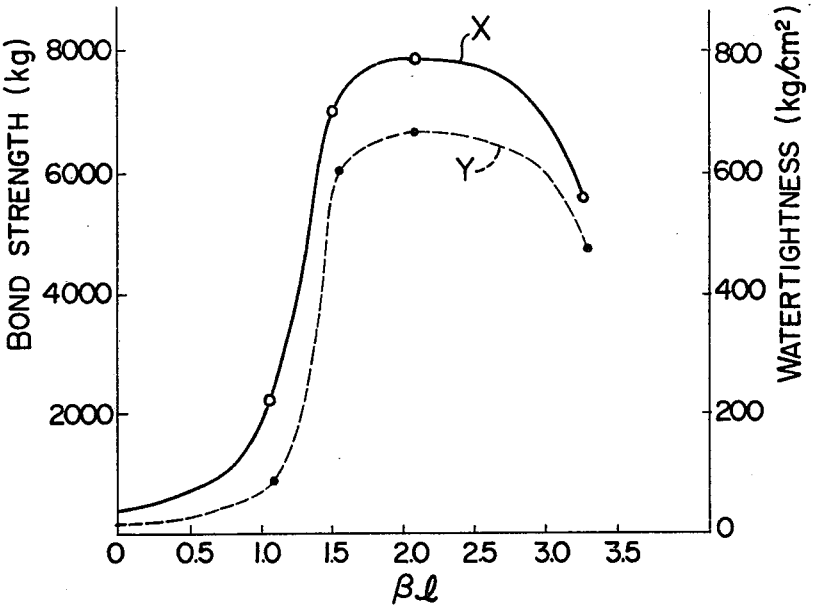
Figure 7:
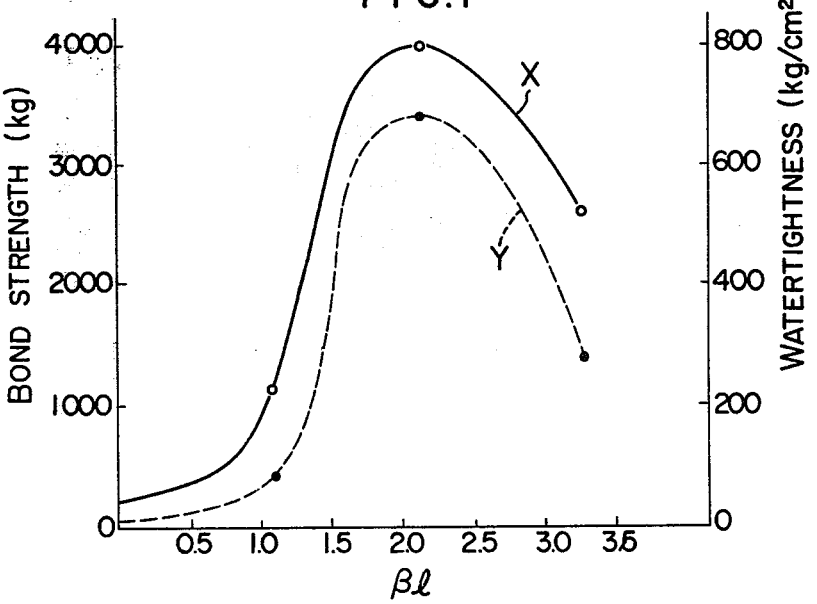
Figure 8:
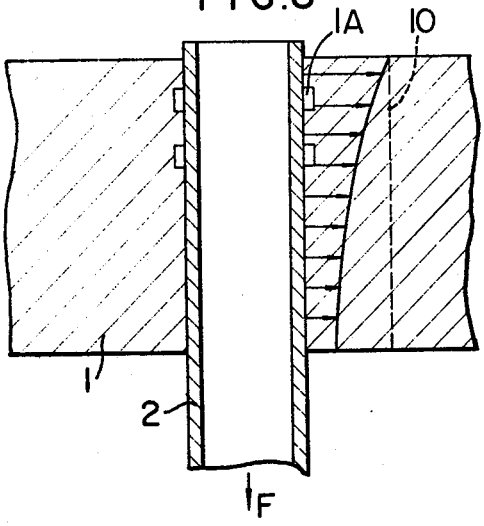
Figure 9:
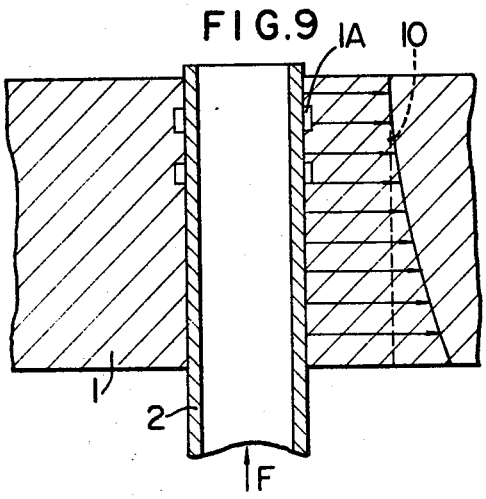
Figure 10:
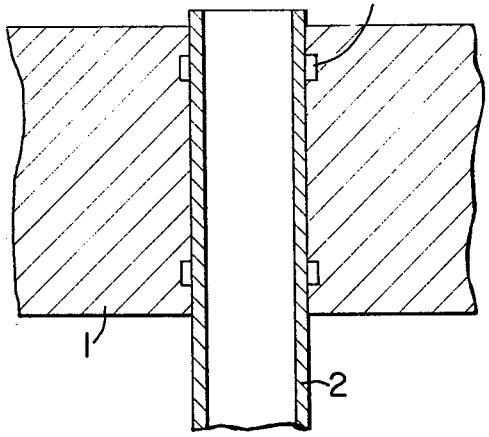
Figure 11:
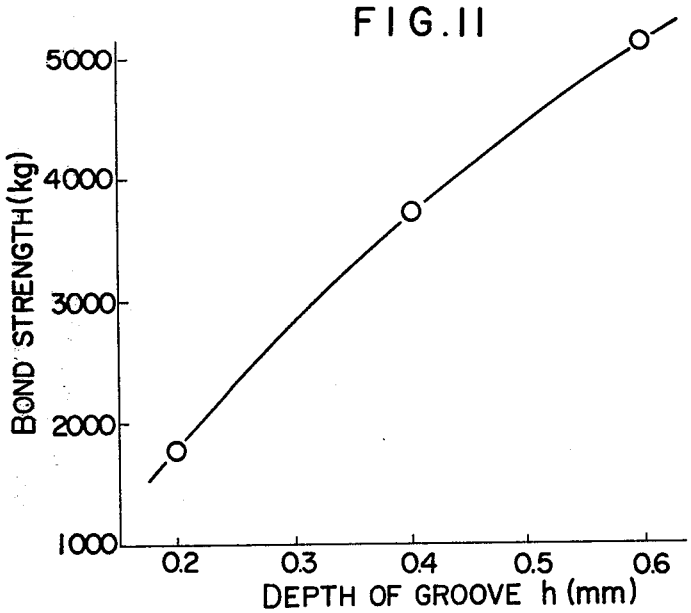
Figure 12:
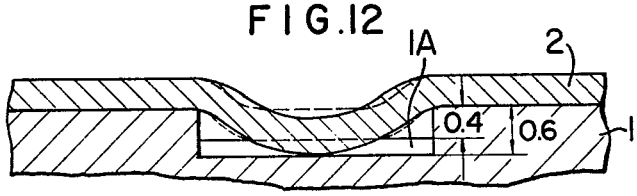

FIGS. 5*a* and 5*b* are views illustrating the deformations of tubes relative to grooves 4 mm and 6 mm in length, respectively;

FIG. 6 is a graph summarizing the results of a series of experiments conducted by us, indicating the relations of the bond strength and watertightness of the joint to $\beta l$;

FIG. 7 is a graph similar to FIG. 6 but showing the results of another series of our experiments;

FIG. 8 is a sectional view illustrating the residual stress distribution and pull-off load distribution in the tube-sheet region around a tube hole in which a tube has been expanded;

FIG. 9 is a sectional view illustrating the residual stress and push-off load distributions in the same region;

FIG. 10 is a sectional view of another embodiment of the invention modified to cope with the conditions illustrated in FIGS. 8 and 9;

FIG. 11 is a graph showing the relationship between the depth of groove and bond strength of the joint based upon our experiments; and FIG. 12 is a sectional view illustrating the deformations of a tube with respect to grooves 0.4 and 0.6 mm in depth.

Figure 1:
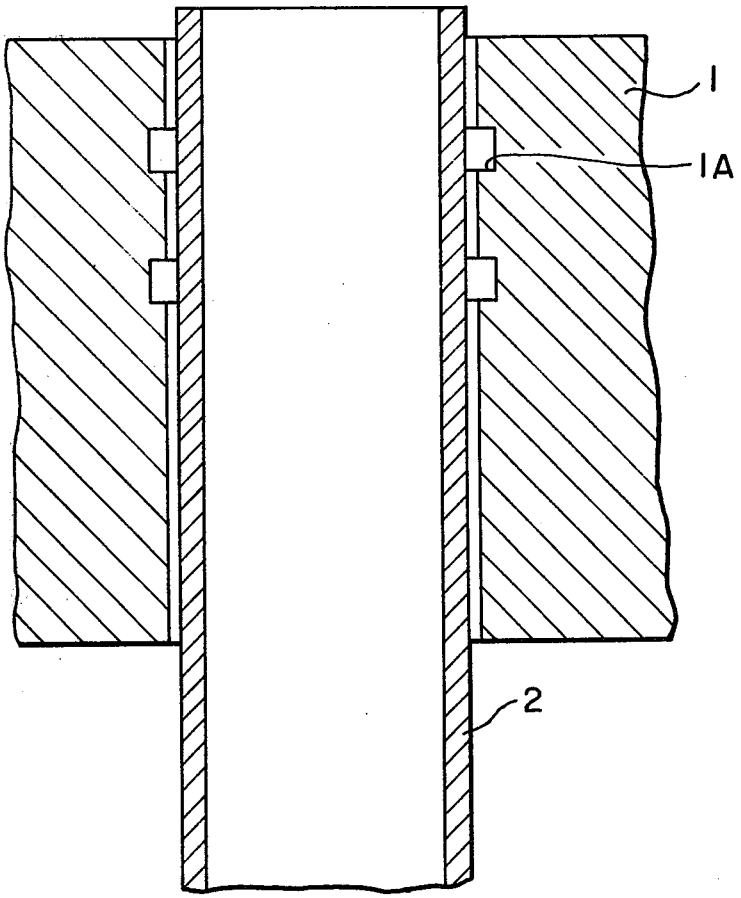
FIG. 1 is a sectional view of a tube-hole structure embodying the invention, with a heat-transfer tube to be expanded shown inserted in the particular hole of a heat-exchanger tube-sheet.

Referring now to FIG. 1, there is shown, in cross section, a fragment of a tube sheet of perforated construction embodying the invention for a shell-and-tube heat exchanger, with a heat-transfer tube inserted into one of the tube holes so as to be secured in place.

The tube sheet, generally indicated at 1, is shown with one of its holes receiving the heat-transfer tube 2 to be subsequently secured to the surrounding wall thereof. In accordance with the invention, the tube-sheet hole has annular grooves 1A formed on the surrounding wall. In the embodiment illustrated, two such grooves 1A are provided in each hole. Inside the hole with the grooves 1A, the tube 2 is radially expanded to produce a solid joint, in the manner now to be described with reference to FIGS. 2 and 3. The two figures show, in cross section, the tube in the hole, respectively, before and after the expansion by means of a uniformly-stretchable tube expander inserted in the tube.

Figure 2:
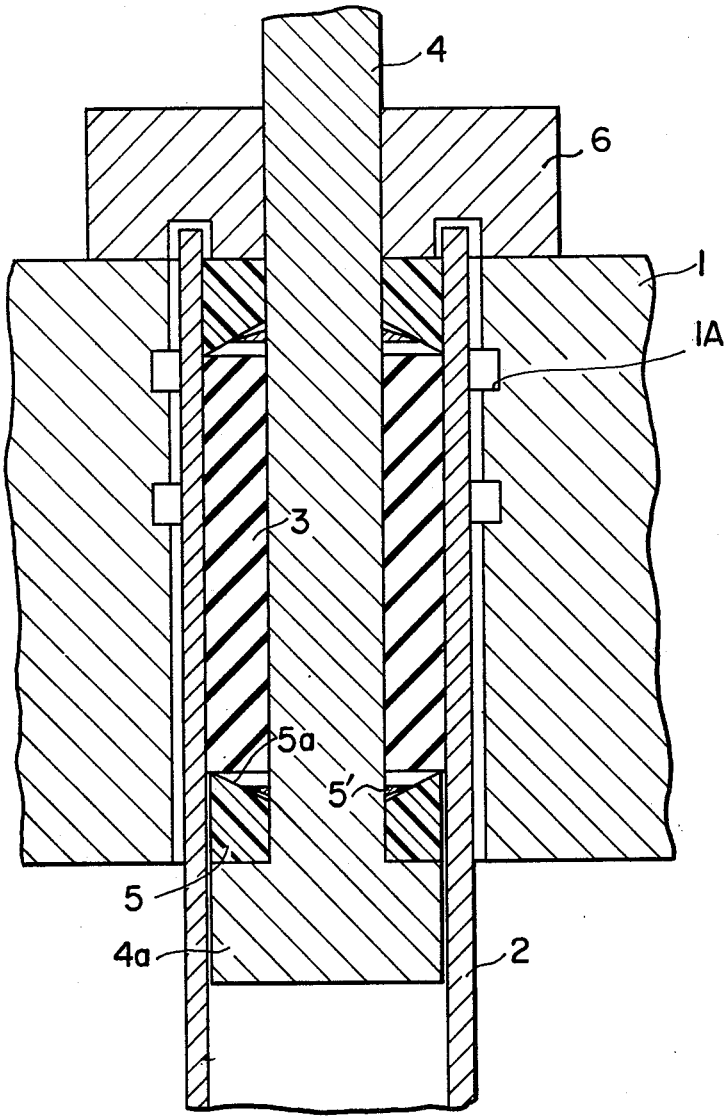
FIG. 2 is a sectional view of the tube-hole structure with a uniformly-stretchable tube expander inserted into the tube in the hole.

Turning to FIG. 2, the uniformly-stretchable tube expander is shown comprising an elastic, cylindrical tube-expanding medium 3, a pressure rod 4 extending substantially through the axial center of the medium 3, with the outer end of the rod being connected to a piston in a hydraulic cylinder not shown and the opposite end provided with a pressure head 4*a*, a pair of seal rings 5 of an elastic material more rigid than the medium 3 and having a conical recess 5*a* on the side facing the medium, said seal rings being located on both ends of the medium and receiving said pressure rod 4 slidably therethrough, auxiliary seal rings 5' for preventing the flow of the tube-expanding medium 3 into the spaces to be formed between the pressure rod 4 and the seal rings 5 during the deformation under pressure, and a backup ring 6 attached to the tube sheet 1 to cover and hold one of the seal rings 5 in place.

This tube expander is used to expand and secure the heat-transfer tube 2 into the hole of the tube sheet 1 in the following way. First, as shown in FIG. 2, the expander is introduced into the tube 2 in the hole, and the piston of the hydraulic cylinder is actuated so that the pressure rod 4 can be subjected to a pull, or a force F, and is moved in the axial direction. Since the force F is applied to the pressure head 4*a*, too, the tube-expanding medium 3 is compressed axially, and concommitant radial expansion of the mass stretches the tube 2 uniformly in the radial direction until the tube is solidly secured to the surrounding wall of the hole in the tube sheet 1. The tube and tube sheet united in this way are shown in FIG. 3.

Figure 3:
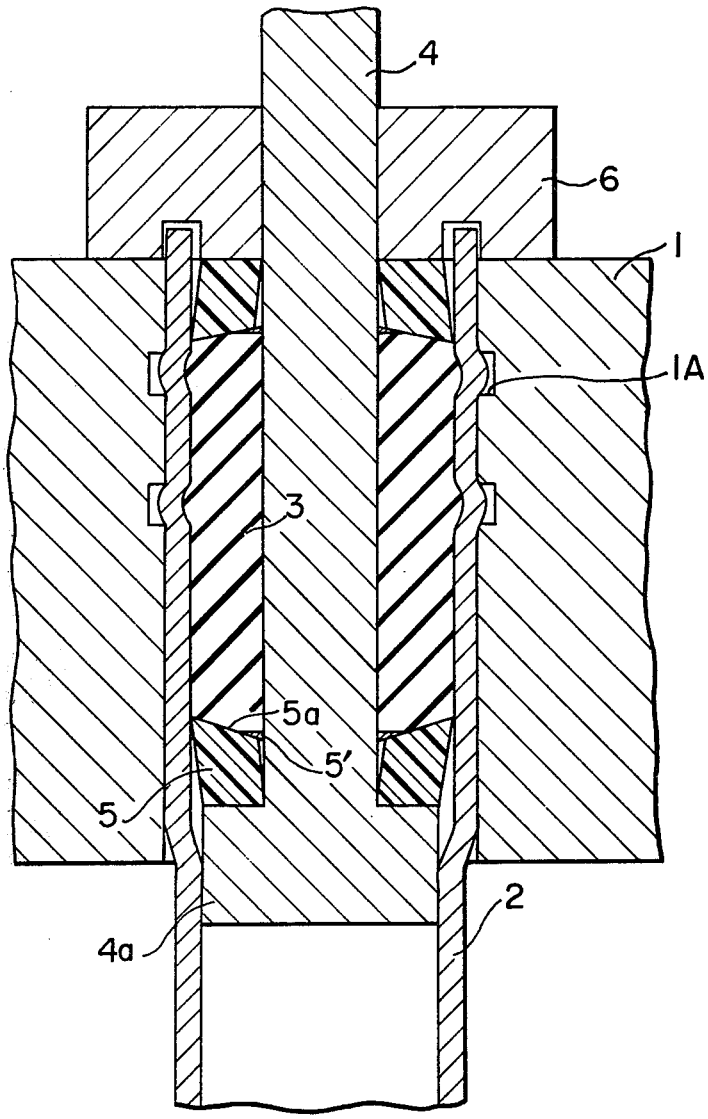
FIG. 3 is a view similar to FIG. 2 but showing the tube expanded and secured in place.

As is indicated in FIG. 3, the surrounding wall of each tube-sheet hole embodying our invention is grooved, and therefore the tube 2 in the hole upon stretching by the tube expander will be partly deformed and forced into the grooves 1A to provide a joint.

The tube 2 is forced into the grooves 1A by the tube expander, as it is expanded by the uniform internal pressure exerted by the radial displacement of the tube-expanding medium 3. The tube portions facing the grooves 1A, where the resistance to deformation is the least, are deformed and expanded under the pressure into the grooves 1A.

With an increased force of contact between the corners of the grooves 1A and the tube 2 partly deformed thereover, a good tube-and-tube-sheet joint results. The joint thus obtained is greatly improved over the conventional joints in both bond strength and watertightness.

After diversified investigations we have now found that the grooves 1A of a certain axial dimension or length can provide additional strength and tightness for the joint to be formed between the tube 2 and the tube sheet 1 by the uniform tube expansion. The principle will be explained below.

Figure 4:
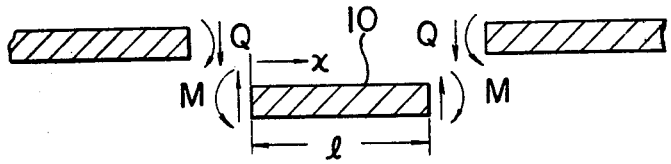
FIG. 4 is a view explanatory of the statically indeterminate load applicable on a groove assumed as a ring of the corresponding length.

The possibility of deforming the portions of a heat-transfer tube along the grooves of the tube hole during the tube expansion with the application of a uniform internal pressure by the uniformly-stretchable tube expander, may be approximately calculated as follows. As shown in FIG. 4, the tube portion to face each groove of the tube hole is taken out in the form of a ring, and the radial displacement $\delta p$ that it will undergo upon subjection to the internal pressure p, is calculated. In order that the ring having undergone the radial displacment $\delta p$ be combined with the tube portions at the both ends under conditions of continuity, a statically determinate shearing force Q and moment load M are allowed to act on both ends of the ring. The shearing force Q and moment load M can be calculated by solving the following simultaneous equations (1), (2) based on the theory of the cylindrical shell.

$$\delta_o = -\delta p = \left(\frac{B_{11} + G_{11}}{2\beta^3 D}\right) Q + \left(\frac{B_{12} + G_{12}}{2\beta^2 D}\right) M \quad (1)$$

$$V_o = -\left(\frac{B_{12} + G_{12}}{2\beta^2 D}\right) Q - \left(\frac{B_{22} + G_{22}}{2\beta D}\right) M \quad (2)$$

where $\delta_o$: ring end displacement (mm)

$V_o$: angle of ring end displacement (rad)

$$\beta: \sqrt[4]{\frac{3(l - \nu^2)}{R^2 t^2}} \quad (\mathrm{l/mm})$$

$$D: \frac{Et^3}{12(l - \nu^2)} \quad (\mathrm{kg \cdot mm})$$

R: mean radius of the tube (mm)

t: wall thickness of the tube (mm)

E: Young's modulus (kg/mm$^2$)

$\nu$: Poisson's ratio $B_{11}$, $B_{12}$, $B_{22}$, $G_{11}$, $G_{12}$, $G_{22}$: values given as functions of the groove length l, R, and t.

The radial displacement $\delta$ at a given point of the ring, when the ring is subjected to the shearing force Q and moment load M at both ends, is given by $$\delta = \frac{Q}{2\beta^3 D} F_{11}(\beta x) + \frac{M}{2\beta^2 D} F_{11}(\beta x) + \delta_0 F_{14}(\beta x) \quad (3)$$

where $$F_{11}(\beta x) = \frac{(\cosh\beta x \sin\beta x - \sinh\beta x \cos\beta x)}{2}$$

$F_{12}(\beta x) = \sinh \beta x \sin \beta x$ $F_{14}(\beta x) = \cosh \beta x \cos \beta x$ x: distance between the ring end and the given point (mm)

The distribution of radial displacements of the ring calculated from Eq. (3) represents the general deformation of the tube along the grooves.

In accordance with the foregoing calculation procedure, the conditions of deformation that the tubes of the sizes (as tabulated below) most often used with heat exchangers would undergo in the portions facing the grooves of tube holes, were calculated. On the basis of the calculation the conditions of deformation in the face of grooves of different lengths, l = 4 mm and l = 6 mm, are illustrated by way of comparison in FIG. 5.

Table

| Tube outside dia. (mm) | Tube wall thickness (mm) | $\beta$ |
|---|---|---|
| 15.9 | 1.2 | 0.4327 |
| 19.0 | 1.6 | 0.3444 |
| 25.4 | 2.0 | 0.2656 |
| 27.2 | 2.6 | 0.2272 |
| 34.0 | 3.2 | 0.1830 |

FIG. 5 shows how the tube of a size selected from the table, 25.4 mm in outside diameter and 2 mm in wall thickness (made of stainless steel and assumed to have a Poisson's ratio of 0.3) is deformed by expansion relative to grooves of different lengths, i.e., a 6 mm-long groove where added bond strength and watertightness are attained and a 4 mm-long groove where little improvements are expected in these respects. For the calculation the pressure applied by the uniformly-stretchable tube expander was estimated at 3000 kg/cm$^2$. As can be seen from FIG. 5*a*, the tube portion facing the 4 mm-long groove remains practically undeformed. Although it may appear that a higher pressure by the uniformly-stretchable tube expander makes deformation possible, the pressure increase is considered difficult for the tube-expanding mechanism. The tube in FIG. 5*b* is again 25.4 mm in outside diameter and 2 mm in wall thickness, but the groove it faces has a length l of 6 mm, or is longer than in FIG. 5*a*. The tube is shown deformed along, and expanded into, the groove. It will be understood that this deformation results in a joint with increased strength and tightness.

With a heat-transfer tube 25.4 mm in outside diameter and 2 mm in wall thickness, the coefficient ($\beta$) in the theory of shell that is given as a function of these dimensions is expressed by $$\beta = \sqrt[4]{\frac{3(1-\nu^2)}{R^2t^2}}$$

where

R: mean radius of the tube t: wall thickness of the tube $\nu$: Poisson's ratio

From the table, $\beta = 0.2656$ in the case just described above, and the product of $\beta$ multiplied by the groove length l, or $\beta l$, is approximately 1.5.

It is obvious that, where l is 6 mm or more, the tube is easily deformed, and therefore a good result is obtained when $\beta l > 1.5$ $l > 1.5/\beta$ The high bond strength and watertightness of the resulting joint are presumably attributable to an increase in the shearing resistance and an added pressure of contact between the tube and the groove corners. However, an excessive groove length l will reduce the shearing resistance and contact pressure and therefore the strength and tightness of the joint. This means that l has its upper limit, although $l > 1.5/\beta$. The results of our experiments made in search of the practical upper limit are graphically represented in FIGS. 6, 7 and 8.

FIG. 6 shows the bond strength and watertightness of joints formed by expansion with a uniformly-stretchable tube expander between heat transfer tubes of stainless steel (25.4 mm in outside diameter and 2 mm in thickness) and a tube sheet of stainless steel (50 mm in diameter and 50 mm in length).

In FIG. 6 the $\beta l$ is plotted as abscissa and the resulting bond strength and watertightness of the joint, as ordinates. The full-line curve X represents the strength and the broken-line curve Y, the watertightness of the joint. As can be seen from the graph, where the groove length l is 4 mm or where $\beta l$ is 1.1, the bond strength value is about 2500 kg and the watertightness value is about 100 kg/cm$^2$. Also, where the groove length is 6 mm or $\beta l$ is 1.5, the bond strength is 7000 kg and the watertightness is 600 kg/cm$^2$, both greater than were l = 4 mm. It is then clear that increasing the groove length l to 6 mm, i.e., to $\beta l = 1.5$, will improve the bond strength and watertightness of the joint. Especially where the groove length l is 8 mm, or where $\beta l$ is 2.1, even greater effects are achieved, with a bond strength of 7500 kg and watertightness of 650 kg/cm$^2$. These beneficial effects are lost, however, where the groove length l = 12 mm, or where $\beta l$ is 3.2, since it reduces the bond strength to about 5500 kg and the watertightness to about 450 kg/cm$^2$. Usually, with the tube-hole structure under the above-mentioned conditions, the bond strength of the tube-and-tube-sheet joint is not less than 7000 kg and the watertightness of the joint is not less than 600 kg/cm$^2$. The series of experiments conducted by us indicate that, where the $\beta l$ is within the range between 1.5 and 3.0, the strength and tightness both surpass the usual levels upwardly, showing that the upper limit of $\beta l$ is 3.0.

FIG. 7 is a graph similar to FIG. 6, but the data plotted therein are of joints formed between tubes of titanium (25.4 mm in outside diameter and 1.7 mm in wall thickness) and a tube sheet of carbon steel (50 mm in diameter and 50 mm in length). In case of the tube-hole structure under these conditions, the joint is required to have a bond strength of over 3000 kg and a watertightness of over 400 kg/cm$^2$. It will be seen from the graph that the $\beta l$ that meets both requirements is in the range from 1.5 to 3.0.

As will be clearly understood from the experimental results plotted, it is only necessary that the $\beta l$ be within the range from 1.5 to 3.0 if the joint strength and watertightness required of the tube-hole contours are to be obtained. This means that the groove length l may be suitably chosen from the range $1.5/\beta$ to $3.0/\beta$.

Presumably the bond strength and watertightness of the joint between the expanded tube portion and the surrounding wall of the tube hole depend also upon the location where the groove is formed by machining or otherwise. The bond strength of such joint is governed by the residual stress (after the tube expansion) in the expanded tube portion and also by the coefficient of friction between the tube and the tube sheet. The pressure distribution varies, however, according to whether the tube expander is pulled out of the tube 2 or is pushed off from the tube as shown, respectively, in FIG. 8 or 9. In case of the pull-off load, the tube expander is pulled off in the direction F in FIG. 8, when, as indicated by the arrow, the nearer to the grooves 1A the higher the load, and the farther from the grooves the lower the load will be. In case of the push-off load, the tube expander is pushed off in the direction F in FIG. 9, when, as indicated by the arrows, the load distribution will be reverse to that illustrated in FIG. 8. Despite the provision of the grooves 1A, it will no longer be possible to make effective use of them. (The numeral 10 denotes the residual stress after the tube expansion.) Thus, it is presumed that shifting the location of the grooves 1A may further improve the reliability of the tube-and-tube-sheet joint in respect of the bond strength and watertightness. On the basis of this presumption, a modified construction shown in FIG. 10 has two grooves 1A formed far apart, toward both ends of the tube hole or near the front and rear (inner) sides of the tube sheet so that the joint can exhibit stable strength against the load that will be exerted by the tube expander as the latter is pulled or pushed off from the expanded tube. In this way the residual stress is adequately maintained after the tube expansion. In the shifted positions the grooves 1A still have their axial dimension or length l within the range of $1.5/\beta$ to $3.0/\beta$ for high bond strength and watertightness.

Although no mention has so far been made of the depth of the grooves, in the embodiments of the invention described above, it is 0.4 mm. In our further investigations about the relationship between the groove depth (h) and the bond strength of the resulting joint, it has now become clear that, as shown in FIG. 11, the bond strength increases substantially in a straight line as the groove depth increases. This is attributed not only to the expansion of the tube deep in the groove but also to the contours of the tube portions so deformed by expansion. For instance, where the groove is 0.4 mm deep, the tube is rather slightly deformed as indicated by broken lines in FIG. 12, and no adequate pressure of contact is expected between the corners of the groove 1A and the tube 2. Where the groove depth (h) is 0.6 mm, as indicated by full lines in FIG. 12, the tube is expanded to a greater extent into the groove 1A, with an accordingly increased pressure of contact between the corners of the groove 1A and the tube 2. Thus, it will be appreciated that the grooves deeper than the usual depth of 0.4 mm will give joints of greater strength and tightness, although the effects will vary more or less.

While some embodiments of the invention have been described in which the tube is expanded by a uniformly-stretchable tube expander into the tube hole, any other tube-expanding means, e.g., explosive, direct pressure-application, or other mechanical tube expander, may be employed instead, provided that a groove or grooves are formed in the tube hole for added bond strength and watertightness of the joint.

As described above, the tube-hole structure for an expanded tube-to-tube-sheet joint according to the invention is characterized by at least one groove formed circumferentially in each tube hole of the tube sheet into which each tube is inserted and radially expanded to provide a joint. The tube is thus expanded and deformed into the groove, and an increased pressure of contact between the corners of the groove and the tube results in added bond strength and watertightness.

What is claimed is:

1. A tube-hole structure for an expanded tube-to-tube-sheet joint wherein at least one circumferential groove is formed on the surrounding wall of each tube hole of a sheet into which each tube member is inserted and uniformly expanded to provide a joint, characterized in that the axial dimension of each said groove is in the range from about $1.5/\beta$ to about $3.0/\beta$ ($\beta$ being calculated from $$\sqrt[4]{\frac{3(1-\nu^2)}{R^2t^2}},$$

wherein R is the mean radius of the tube member to be expanded, t is the wall thickness of the tube member, and $\nu$ is the Poisson's ratio).

2. The tube-hole structure of claim 1, characterized in that said tube member is radially outwardly and uniformly expanded by means of a tube-expanding medium of elastic material disposed inside of said tube member.

3. The tube-hole structure of claim 1, characterized in that two grooves are formed near both ends of each said tube hole.

4. The tube-hole structure of claim 1, characterized in that the depth of each said groove is not less than 0.4 mm.

5. A method of manufacturing a tube-hole structure for an expanded tube-to-tube-sheet joint comprising the steps of:

a. forming at least one circumferential groove on a surrounding wall of each tube hole of a tube sheet, wherein the axial dimension of each said groove is in the range from about $1.5/\beta$ to about $3.0/\beta$ ($\beta$ being calculated from $$\sqrt[4]{\frac{3(1-\nu^2)}{R^2t^2}},$$

wherein R is the mean radius of a tube member to be expanded, t is the wall thickness of the tube member, and $\nu$ is Poisson's ratio;

b. inserting one tube member into each tube hole of the tube sheet; and c. expanding said tube member into said circumferential groove to provide a joint.

6. The method of manufacturing the tube-hole structure according to claim 5, further comprising the step of disposing a tube-expanding medium means of elastic material inside of said tube member for radially outwardly and uniformly expanding said tube member.

7. The method of manufacturing the tube-hole structure according to claim 5, further comprising the step of forming two grooves near both ends of each said tube hole.

8. The method of manufacturing the tube-hole structure according to claim 5, further comprising the step of making the depth of each said groove not less than 0.4 mm.

* * * * *